US008864478B2

(12) United States Patent
Trubnikov

(10) Patent No.: US 8,864,478 B2
(45) Date of Patent: Oct. 21, 2014

(54) SYSTEM AND METHOD FOR PRELOADING A HIGH STRESS AREA OF A COMPONENT

(75) Inventor: Timur T. Trubnikov, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 1646 days.

(21) Appl. No.: 11/809,988

(22) Filed: Jun. 4, 2007

(65) Prior Publication Data

US 2008/0298991 A1 Dec. 4, 2008

(51) Int. Cl.
*F04B 39/00* (2006.01)
*F04B 1/04* (2006.01)
*F04B 53/16* (2006.01)

(52) U.S. Cl.
CPC ..... *F04B 1/0421* (2013.01); *F04B 53/16* (2013.01)
USPC ..... 417/521; 417/572; 29/446

(58) Field of Classification Search
USPC ..... 417/159, 364, 380, 470, 521; 29/428, 29/445, 448, 452, 888, 888.01, 888.02, 29/888.03, 888.04; 92/146, 169.2, 188, 92/256, 258; 123/450, 456, 495, 508, 496; 137/540; 220/233
See application file for complete search history.

(56) References Cited

U.S. PATENT DOCUMENTS 3,347,465 A * 10/1967 Shieber ..... 239/265.11
3,525,365 A * 8/1970 Boyle et al. ..... 138/89
4,325,914 A * 4/1982 Ruyak ..... 422/547
4,669,368 A 6/1987 Looper et al.
5,100,301 A * 3/1992 Hidaka et al. ..... 417/222.2
5,124,555 A 6/1992 Hartl
5,228,473 A * 7/1993 Zink ..... 137/347
6,053,682 A * 4/2000 Krauter et al. ..... 411/369
6,142,186 A * 11/2000 Donovan ..... 138/89
6,199,925 B1 * 3/2001 Alba ..... 294/1.1
6,224,350 B1 * 5/2001 Guentert et al. ..... 417/273
6,241,492 B1 * 6/2001 Pacht ..... 417/567
6,470,856 B1 * 10/2002 Boecking ..... 123/456
7,021,510 B2 * 4/2006 Ellingson ..... 226/172
2003/0107021 A1 * 6/2003 Saurwein et al. ..... 251/360
2004/0035396 A1 * 2/2004 Braun et al. ..... 123/447
2006/0246396 A1 * 11/2006 Suttin et al. ..... 433/173
2007/0172795 A1 * 7/2007 Lang et al. ..... 433/173
2007/0201965 A1 * 8/2007 Littlewood ..... 411/46

OTHER PUBLICATIONS

Definition of plug, http://en.wiktionary.org/wiki/plug (last visited Aug. 8, 2011).*

* cited by examiner

*Primary Examiner* — Charles Freay
*Assistant Examiner* — Christopher Bobish
(74) *Attorney, Agent, or Firm* — Miller, Matthias & Hull

(57) ABSTRACT

The exposure of components to high-pressure fluids can result in the application of high tensile stresses to those components, which may lead to reduced life. The preload system described herein helps to reduce the magnitude of those tensile stresses by providing a body and a plug. The body includes a first bore and a second bore. The first bore is configured to be exposed to high tensile stresses. The second bore includes a first engagement structure and a bottom surface near a first portion of the first bore. The plug includes a second engagement structure and a first end. The second engagement structure engages the first engagement structure to force the first end of the plug against the bottom surface of the bore. The force of the plug against the bottom surface of the bore applies a compressive preload to the first portion of the first bore.

26 Claims, 4 Drawing Sheets

SYSTEM AND METHOD FOR PRELOADING A HIGH STRESS AREA OF A COMPONENT

TECHNICAL FIELD

The present disclosure relates to a system and method for applying a preload to a high stress area of a component. More particularly, the present disclosure relates to a system and method for applying a compressive preload to high stress areas of high-pressure pumps.

BACKGROUND

In order to meet the increasingly stringent emissions regulations, diesel engine manufacturers are exploring different avenues for reducing the regulated components of diesel engine emissions. One approach is to increase the injection pressure of the fuel that is injected into the combustion chamber to achieve a more complete mixture of the fuel and air. Although there are a number of different types of fuel injection systems used to achieve the higher injection pressures, the common rail type of fuel system has become increasingly popular. Many of today's common rail fuel systems rely solely on a high-pressure pump to achieve the desired injection pressures. However, as the desired injection pressures increase, it has become increasingly difficult to manufacture high-pressure pumps that are efficient enough and robust enough to consistently and reliably provide fuel at such high pressures, and at the same time, balance cost, weight, packaging, and a multitude of other factors.

One of the primary issues that manufacturers must address is the structural integrity of the portions of the pump that are exposed to the high pressures generated by the pump. At these high pressures, the forces applied by the pressurized fluid can create significant tensile stresses within the material forming the structural portions of the pump. This is especially true at areas where there may be stress concentrations, such as at corners or edges of bores. In addition, the cyclical nature of the pressures to which these materials are exposed exacerbates the problem, requiring the use of materials or a design that not only exhibits sufficient strength but also possesses sufficient fatigue capacity. Over time, the magnitude of the tensile stresses and/or the multitude of cyclical applications of pressurized fluid may result in failure of the pump.

One technique manufacturers have used to combat the tensile stresses applied by the high pressure fluid is to impart residual compressive stresses to the material of the pump exposed to the high pressure fluid. Different manufacturing techniques, such as bead blasting, shot peening, and carburizing may be used to impart such residual compressive stresses or preload. Although the use of compressive residual stresses helps to counter the high tensile stresses to which a material may be exposed, the magnitudes of such residual compressive stresses are limited and are becoming insufficient to counter the continuously increasing tensile stresses that result from the higher injection pressures of today's and tomorrow's fuel systems. Moreover, depending on the location of the material to which one desires to apply a residual preload, the use of one or more of the conventional manufacturing techniques relied upon to impart a residual compressive stress or preload may be difficult. For example, when an area that is exposed to high pressure fluid is located deep within a small bore in a component, it may be difficult to utilize a shot peening or bead blasting technique to impart a compressive preload.

It would be desirable to provide a system and method for applying a compressive preload that is able to overcome one or more of the shortcomings described above.

SUMMARY

According to one exemplary embodiment, a preload system comprises a body and a plug. The body includes a first bore and a second bore. The first bore is configured to be exposed to high tensile stresses. The second bore includes a first engagement structure and a bottom surface near a first portion of the first bore. The plug includes a second engagement structure and a first end. The second engagement structure engages the first engagement structure to force the first end of the plug against the bottom surface of the bore. The force of the plug against the bottom surface of the bore applies a compressive preload to the first portion of the first bore.

According to another exemplary embodiment, a pump comprises a housing, a driven member, a head, a plug, and a plunger. The driven member is coupled to the housing. The head is coupled to the housing and defines a first bore and a second bore. The first bore includes a first portion exposed to a pressurized fluid. The second bore includes a bottom located near the first portion. The plug is coupled within the second bore and is configured to apply a force to the bottom of the second bore. The plunger is coupled to the driven member and is configured to reciprocate within the first bore in response to the driven member. The plunger and the first bore at least partially define a pumping chamber. The reciprocation of the plunger in the first bore results in the pressurization of the pressurized fluid within the pumping chamber. The pressurized fluid subjects at least the first portion of the first bore to tensile stresses. The force applied to the bottom of the second bore by the plug subjects the first portion of the first bore to compressive stresses that at least partially offset the tensile stresses to which the first portion is subjected by the pressurized fluid.

According to another exemplary embodiment, a method of applying a compressive preload to a body including a first bore, at least a portion of which is exposed to high tensile stresses, comprises the step of forcing an end of a plug against a bottom of a second bore, the bottom of the second bore being near the at least a portion of the first bore. The method also comprises the step of continuing to force the end of the plug against the bottom of the second bore until a compressive preload of a desired magnitude is applied to the at least a portion of the first bore.

DETAILED DESCRIPTION

Figure 1:
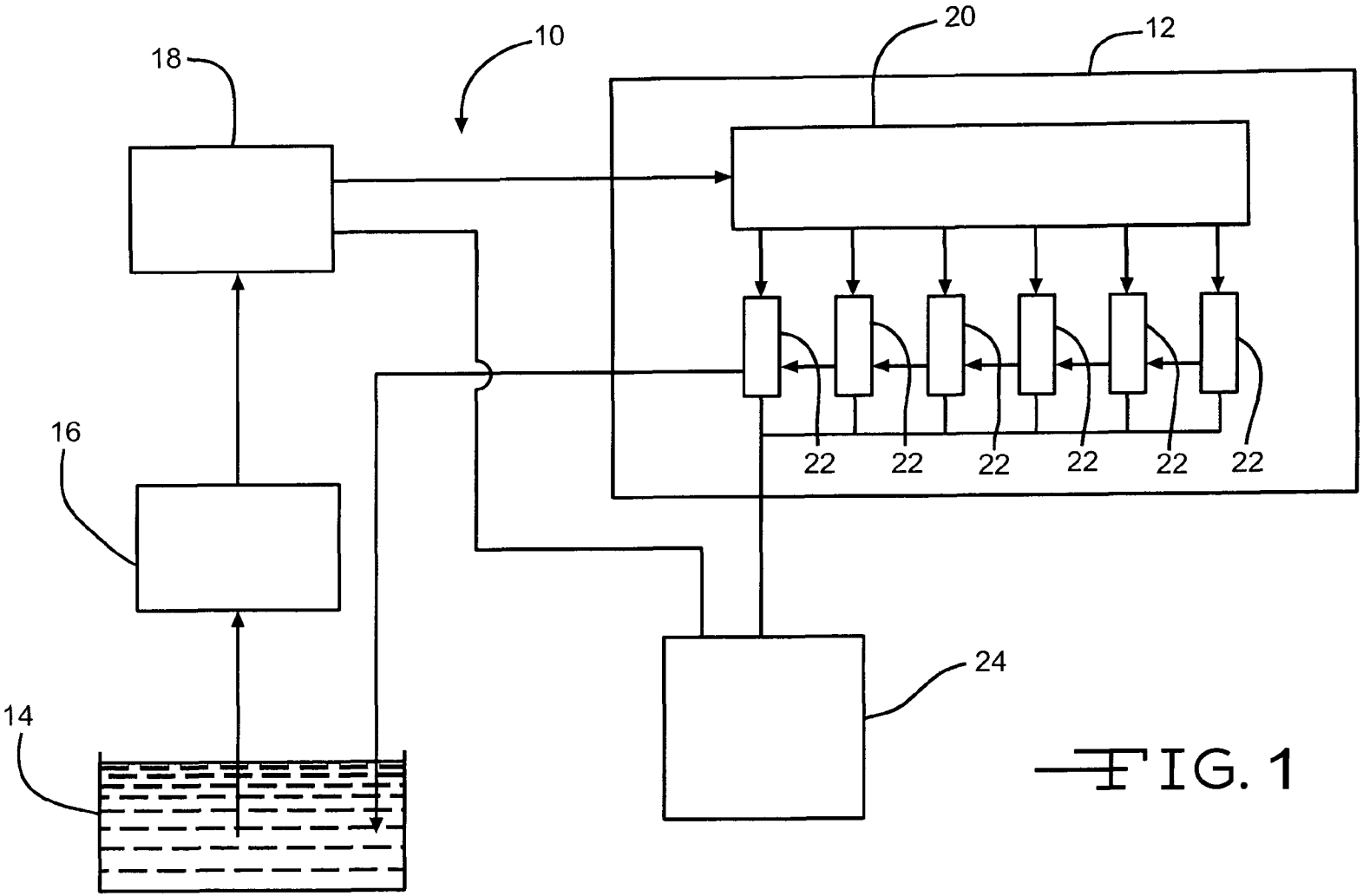
FIG. 1 is a schematic illustration of a fuel system according to one exemplary embodiment.

Referring generally to FIG. 1, a fuel system 10 is shown according to one exemplary embodiment. Fuel system 10 is a system of components that cooperate to deliver fuel (e.g., diesel, gasoline, heavy fuel, etc.) from a location where fuel is stored to the combustion chamber(s) of an engine 12 where it will combust and where the energy released by the combustion process will be captured by engine 12 and used to generate a mechanical source of power. Although depicted in FIG. 1 as a fuel system for a diesel engine, fuel system 10 may be the fuel system of any type of engine (e.g., an internal combustion engine such as a diesel or gasoline engine, a turbine, etc.). According to one exemplary embodiment, fuel system 10 includes a tank 14, a transfer pump 16, a high-pressure pump 18, a common rail 20, fuel injectors 22, and an electronic control module (ECM) 24.

Tank 14 is a storage container that stores the fuel that fuel system 10 will deliver. Transfer pump 16 pumps fuel from tank 14 and delivers it at a generally low pressure to high-pressure pump 18. High-pressure pump 18, in turn, pressurizes the fuel to a high pressure and delivers the fuel to common rail 20. Common rail 20, which is intended to be maintained at the high pressure generated by high-pressure pump 18, serves as the source of high-pressure fuel for each of fuel injectors 22. Fuel injectors 22 are located within engine 12 in positions that enable fuel injectors 22 to inject high-pressure fuel into the combustion chambers of engine 12 (or into pre-chambers or ports upstream of the combustion chambers in some cases) and generally serve as metering devices that control when fuel is injected into the combustion chambers, how much fuel is injected, and the manner in which the fuel is injected (e.g., the angle of the injected fuel, the spray pattern, etc.). Each fuel injector 22 is continuously fed fuel from common rail 20 such that any fuel injected by a fuel injector 22 is quickly replaced by additional fuel supplied by common rail 20. ECM 24 is a control module that receives multiple input signals from sensors associated with various systems of engine 12 (including fuel system 10) and indicative of the operating conditions of those various systems (e.g., common rail fuel pressure, fuel temperature, throttle position, engine speed, etc.). ECM 24 uses those inputs to control, among other engine components, the operation of high-pressure pump 18 and each of fuel injectors 22. The purpose of fuel system 10 is to ensure that the fuel is constantly being fed to engine 12 in the appropriate amounts, at the right times, and in the right manner to support the operation of engine 12.

Figure 2:
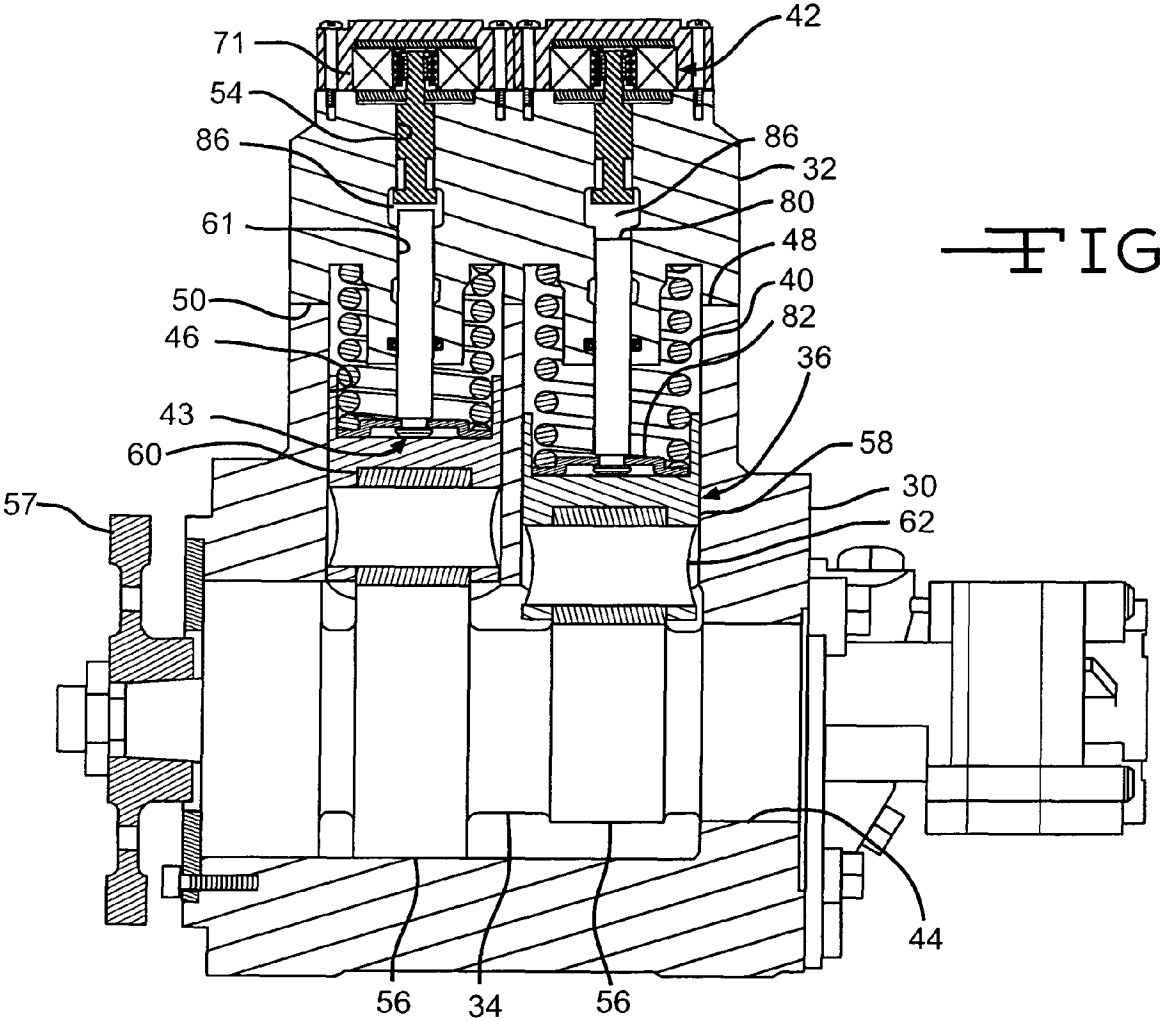
FIG. 2 is a cross-sectional side view of a high-pressure pump according to one exemplary embodiment.

Referring now to FIG. 2, high-pressure pump 18 is configured to increase the pressure of the fuel from a pressure that is sufficient to transfer the fuel from the tank to a pressure that is desirable for the injection of the fuel into the combustion chambers of engine 12 (or injection elsewhere). Such injection pressures may vary between different applications, but often range between approximately 1500 bar and 3000 bar, and may include pressures that are below 1500 bar or above 3000 bar. According to one exemplary embodiment, pump 18 includes a housing 30, a head 32, a camshaft 34, two tappet assemblies 36, two resilient members 40, two plunger assemblies 43, and two control valve assemblies 42. The high pressure pump 18 may further include plugs 47, and two outlet check valve assemblies 45, as best shown in FIGS. 3 and 4.

Housing 30 is a rigid structure that generally serves as the base of pump 18. Housing 30 includes a central bore 44 that is configured to receive camshaft 34, as well as two spaced-apart, parallel tappet bores 46 that are each configured to receive at least a portion of a tappet assembly 36, a plunger assembly 43, a resilient member 40, and head 32. The axis of each tappet bore 46 is arranged perpendicularly (or radially) to the axis of central bore 44 such that the rotation of camshaft 34 within central bore 44 causes tappet assemblies 36 to translate in a linear, reciprocating manner within tappet bores 46. Near the distal ends of tappet bores 46, housing 30 also includes a face 48 that is configured to receive head 32.

Figure 3:
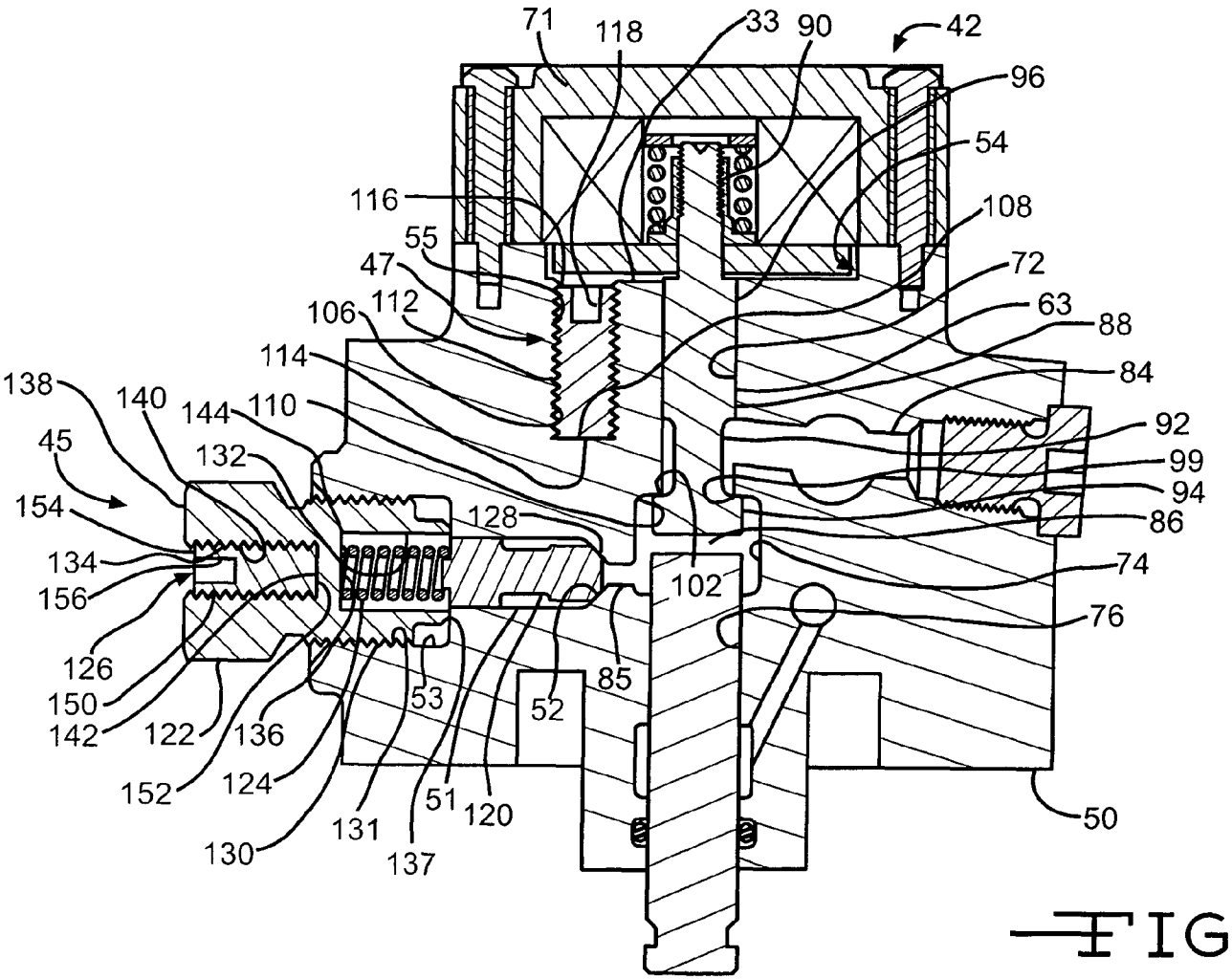
FIG. 3 is a cross-sectional end view of a head of the pump of FIG. 2 illustrating two preload systems according one exemplary embodiment.
Figure 4:
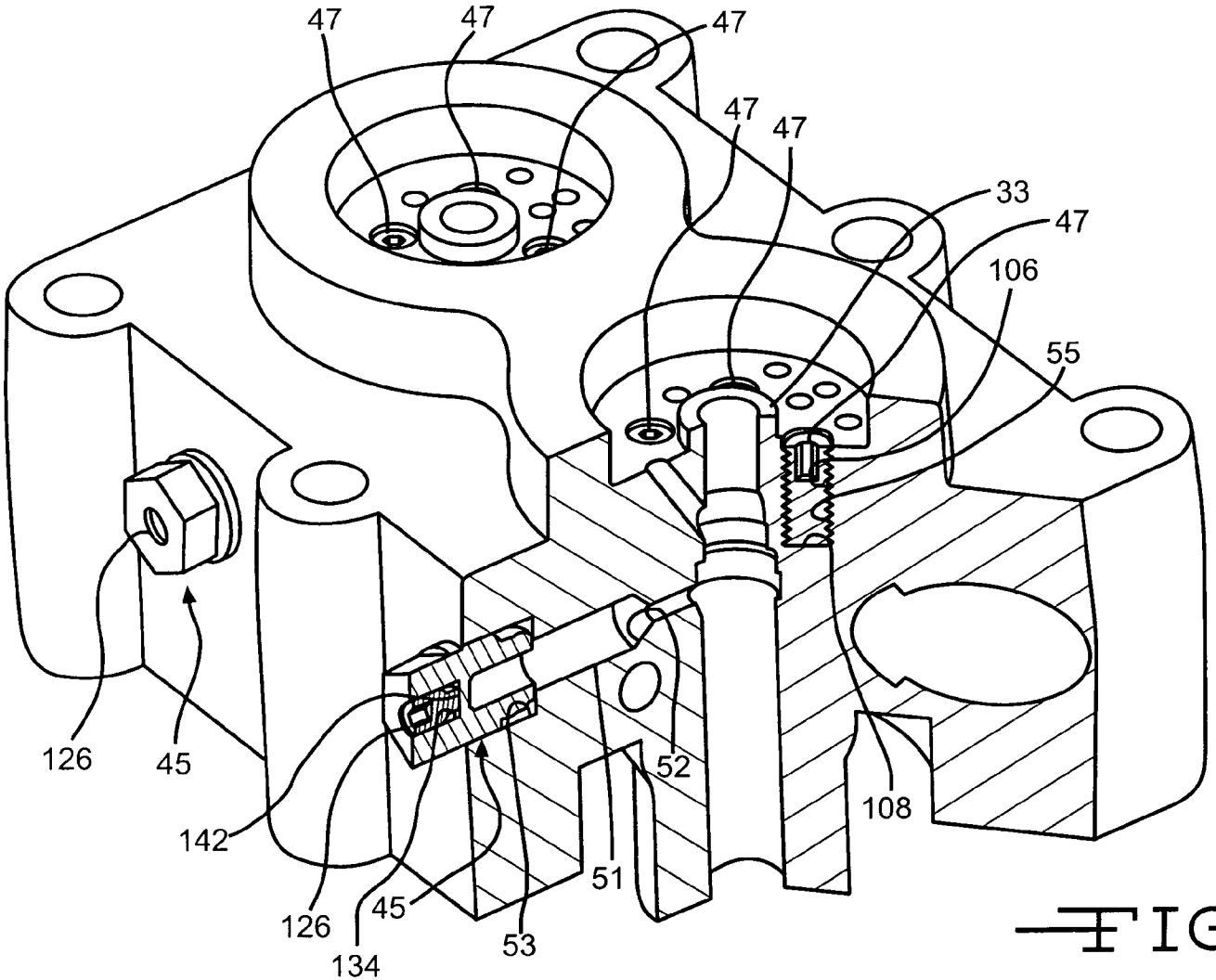
FIG. 4 is a partially cut away perspective view of the head of FIG. 3 illustrating the two preload systems.

Referring now to FIGS. 2 and 3, head 32 is coupled to face 48 of housing 30 and generally serves, among other things, to enclose tappet bores 46, provide a portion of the structure defining pumping chambers 86 (discussed below), receive control valve assemblies 42, and provide various ports and ducts to direct the flow of fuel into and out of pumping chambers 86. According to one exemplary embodiment, head 32 includes a face 50, fuel inlet passages 84, fuel outlet passages 85, two apertures or bores 54, and bores 55.

Face 50 cooperates with face 48 of housing 30 (and optionally a sealing element such as an o-ring) to provide a sealed interface between head 32 and housing 30. Fuel inlet passages 84, one of which is coupled to each pumping chamber 86, are coupled to an outlet of transfer pump 16 and serve as passages to direct fuel to pumping chamber 86. Fuel outlet passages 85, one of which is provided for each pumping chamber 86, are coupled to common rail 20 and serve as a passages to direct fuel from pumping chamber 86 to common rail 20. At least partially within each fuel outlet passage 85 is a first bore 51, a valve seat 52, and a second bore 53, each of which receive or cooperate with a portion of an outlet check valve assembly 45. Each aperture 54 is configured to receive a portion of control valve assembly 42 and a portion of plunger assembly 43. Each aperture 54 includes three primary regions, region 72, region 74, and region 76. Region 72 defines a valve bore that is configured to closely receive and guide a portion of control valve assembly 42. Region 74 defines an intermediate chamber and is located between region 72 and 76. Region 74, in combination with a portion of valve assembly 42, a portion of plunger assembly 43 and region 76, defines pumping chamber 86. Region 76 defines a plunger bore 61 that is configured to receive a portion of plunger assembly 43.

According to one exemplary embodiment, bores 55 (e.g., holes orifices, recesses, etc.) are blind bores that extend into head 32 from a top surface 33 of head 32. Each bore 55 includes an engagement structure 106, such as, for example threads, and a bottom 108. Engagement structure 106 is configured to engage a corresponding structure on a plug 47 to enable plug 47 to be retained within bore 55 in a manner that allows plug 47 to apply a force to bottom 108. According to various alternative and exemplary embodiments, the engagement structure of bores 55 may be any suitable structure that is capable of cooperating with plug 47 to allow plug 47 to be forced against bottom 108 of bore 55. Bottom 108 is intended to be located near a portion of aperture 54 that is exposed to high tensile stresses, such as a corner 110 between region 74 and region 72 of aperture 54, such that, when plug 47 is forced against bottom 108, corner 110 experiences a compressive preload. According to one exemplary embodiment, four bores 55 are provided around each aperture 54 such that each of the four bores 55 are equally spaced circumferentially around, and radially from, aperture 54. The axis of each of the four bores 55 is parallel to the axis of aperture 54. According to various alternative and exemplary embodiments, one, two, three, five, six, or more bores 55 may be provided around aperture 54 and they may be provided in any pattern around aperture 54. According to other alternative and exemplary embodiments, the axes of bores 55 may be angled relative to the axis of aperture 54 (i.e., oriented other than parallel to aperture 54). For example, bores 55 may be angled toward or away from aperture 54 as they extend into head 32 (e.g., angled around an imaginary axis extending between the ends of pump 18), angled toward or away from an end of the pump 18 as they extend into head 32 (e.g., are angled around an imaginary axis extending between the sides of pump 18), angled in another way relative to aperture 54, or certain bores 55 may be angled in different ways than other bores 55.

According to other alternative and exemplary embodiments, bores 55 may start and/or terminate at any locations on pump 18 that are appropriate to allow plugs 47 to apply an appropriate preload to a desired area.

According to one exemplary embodiment, head 32 is integrally formed as a single unitary body. However, according to various alternative and exemplary embodiments, the head may be formed from two or more different pieces or elements coupled together. For example, the portion of head 32 defining region 72 may be replaced by a separate valve guide member that receives a portion of control valve assembly 42 and that is held in place within the head by a nut that engages the head.

Referring to FIG. 2, camshaft 34 is a driven member that is formed from an elongated shaft that includes two sets of cam lobes 56 that are spaced apart along the length of camshaft 34 and a gear or pulley 57 on one of its two ends. Gear or pulley 57 is a driven member that is configured to engage another member, such as another gear, a chain, or a belt, that is driven, either directly or indirectly, by engine 12. The two sets of cam lobes 56 are spaced apart along the length of camshaft 34 so as to correspond with each of the two tappet assemblies 36.

Each tappet assembly 36 (also sometimes referred to as a lifter assembly) is configured to engage one of the two sets of cam lobes 56, transform the rotational movement of the corresponding cam lobes 56 into linear movement, and transfer such linear movement to the corresponding plunger assembly 43. Each tappet assembly 36 includes a body 58 that engages and receives a portion of plunger assembly 43, a roller 60 that engages and follows a set of cam lobes 56, and a pin 62 that couples roller 60 to body 58. Body 58 is received within the corresponding tappet bore 46 of housing 30 and translates back and forth within tappet bore 46 as camshaft 34 rotates.

Resilient member 40, shown as a compression spring, is an element or member that serves to bias the corresponding plunger assembly 43 and tappet assembly 36 toward camshaft 34. By biasing both the corresponding plunger assembly 43 and tappet assembly 36 toward camshaft 34, resilient member 40 helps to ensure that plunger assembly 43 returns to its lowest position (hereinafter referred to as "bottom dead center") before camshaft 34 completes another rotation (or partial rotation, depending on the cam lobe configuration) and forces plunger assembly 43 back up to its highest position (hereinafter referred to as "top dead center"). This helps to ensure that plunger assembly 43 is performing a complete filling cycle (the cycle where plunger assembly 43 moves from top dead center to bottom dead center) and a complete pumping cycle (the cycle where plunger assembly 43 moves from bottom dead center to top dead center) for each cam lobe 56 in the corresponding cam lobe set of camshaft 34.

Plunger assembly 43 is an assembly of components that is located generally between the corresponding tappet assembly 36 and head 32 and that reciprocates with tappet assembly 36 relative to head 32 to pressurize the fluid within pumping chamber 86. According to one exemplary embodiment, plunger assembly 43 includes a plunger 80 and a retainer 82. Plunger 80 is a member (e.g., piston, shaft, rod, element, retained member) that is configured to reciprocate or slide within region 76 of aperture 54 of head 32 as the corresponding tappet assembly 36 reciprocates within tappet bore 46 of housing 30. According to one exemplary embodiment, plunger 80 includes an elongated, generally cylindrical body having a side wall, a first end that is configured to extend into region 76 (and potentially region 74) of aperture 54, and a second end located near tappet assembly 36. First end, regions 76 and 74 of aperture 54, and a portion of control valve assembly 42 define pumping chamber 86, the volume of which changes as plunger 80 moves back and forth, or up and down, within region 76 (and potentially region 74) of aperture 54. Retainer 82 is a component or an assembly of components that couples to plunger 80, that receives resilient element 40 (e.g., spring), and that serves to transfer at least a portion of the force provided by resilient member 40 to plunger 80.

Referring now to FIGS. 2 and 3, each control valve assembly 42 generally serves to control the fluid communication between pumping chamber 86 and the fuel being provided by transfer pump 16, and therefore is capable of controlling the amount of fuel that enters pumping chamber 86 during the filling cycle and the amount of fuel that remains in pumping chamber 86 during the pumping cycle. According to one exemplary embodiment, control valve assembly 42 includes a valve element 63 and an actuator 71.

Valve element 63 is moveable between an open position in which fuel inlet passage 84 is fluidly connected to pumping chamber 86 and a closed position in which fuel inlet passage 84 is not fluidly connected to, or is substantially sealed off from, pumping chamber 86. According to one exemplary embodiment, valve element 63 extends through regions 72 and 74 of aperture 54 and includes a body 88, an armature interface 90, a stem 92, and a head 94. Body 88 is a generally cylindrical portion of valve element 63 and defines a guide surface 96 that cooperates with region 72 of aperture 54 to guide the movement of valve element 63 as valve element 63 slides or reciprocates within region 72. To minimize any fluid leakage that may occur between the surface defining region 72 and body 88, the gap between them may be minimized. Armature interface 90 extends from one end of body 88 and receives a portion of actuator 71 (such as an armature of the actuator, for example). Stem 92 extends from the opposite end of body 88 and, in combination with region 72 of aperture 54, defines a chamber (e.g., a flow chamber) that enables fluid to flow between valve element 63 and region 72 when valve element 63 is in the open position. Head 94 is coupled to the distal end of stem 92 and forms a cap-like structure that allows it to engage a sealing surface 99 of head 32 located between region 72 and region 74 of aperture 54. Head 94 includes a sealing surface 102 that extends perpendicularly and radially outward from the distal end of stem 92 and that is configured to engage sealing surface 99 of head 32. When valve element 63 is moved into the closed position, sealing surface 102 of head 94 is moved into contact with sealing surface 99 of head 32 and creates a sealed interface that is intended to prevent, or substantially prevent, the flow of fluid between inlet passage 84 and pumping chamber 86. When valve element 63 is moved into the open position, sealing surface 102 of head 94 is moved away from sealing surface 99 of head 32, which then allows for the flow of fluid between inlet passage 84 and pumping chamber 86.

Actuator 71 is an electronically controlled device that generates movement in response to an electric signal. Within control valve assembly 42, actuator 71 is coupled to valve element 63 and serves to move valve element 63 relative to head 32 (specifically, relative to the valve bore defined by region 72 of aperture 54) between the open and closed positions. According to various alternative and exemplary embodiments, the actuator may be any suitable actuation device that controls the movement of valve element 63 within aperture 54 in head 32. For example, the actuator may include a solenoid controlled actuation system, a piezo controlled actuation system, a hydraulically controlled actuation system, or any other suitable actuation system.

Referring now to FIGS. 3 and 4, plugs 47, which may be various types of set screws, pins, fittings, bolts, fasteners, screws, studs, etc., are elements that are received within bores 55 of head 32 and that are configured to be forced against bottom 108 of bores 55 to apply a force to the material forming bottom 108. According to one exemplary embodiment, each plug 47 is a generally cylindrical member having an engagement structure 112, an end 114, and an opposite end 116. Engagement structure 112 is configured to engage the engagement structure 106 of a bore 55 in such a way that plug 47 may be forced against bottom 108 of bore 55. One example of engagement structures 112 and 106 are cooperating threads that allow plug 47 to be threaded or screwed into bore 55. With such cooperating threads, the amount of force applied to bottom 108 by plug 47 can be adjusted by rotating plug 47. End 114 is the portion of plug 47 that contacts bottom 108, while end 116 includes a recess 118 (e.g., engagement structure) that is configured to receive a tool that can be used to apply a torque to plug 47. According to one exemplary embodiment, recess 118 is a hexagonal socket that is configured to receive a hex tool or allen wrench. According to other alternative and exemplary embodiments plug 47 may include, either as an alternative to or in addition to recess 118, a different structure that facilitates the application of a torque to plug 47. Such structure may include a hex-shaped head, a square head, a socket to receive a star bit, one or more slots to receive a regular or Phillips head screw driver, or any one or more of a variety of different structures that allow for the application of a torque to plug 47.

According to one exemplary embodiment, bores 55 and plugs 47 cooperate together to form a first preload system that is configured to apply a compressive preload to the material of pump 18 forming pumping chamber 86, particularly the material forming corners 110.

Outlet check valve assemblies 45 are located at least partially within fuel outlet passages 85 and serve as flow limiting apparatuses that prevent (or substantially prevent) the flow of fuel from common rail 20 back into pumping chambers 86, but at the same time, allow pressurized fuel from pumping chamber 86 to flow to common rail 20. According to one exemplary embodiment, each outlet check valve assembly 45 includes a valve element 120, a valve body 122, a valve spring 124, and a plug 126.

Valve element 120 is a generally cylindrical element that is received within first bore 51 of head 32 and that is slideable within first bore 51 between a closed position, in which a seating surface 128 of valve element 120 engages valve seat 52 to substantially prevent the flow of fuel between valve element 120 and valve seat 52, and an open position, in which seating surface 128 does not engage valve seat 52 and fuel is permitted to flow between valve element 120 and valve seat 52. Valve element 120 may include a surface that engages a portion of valve body 122 to serve as a positive stop for valve element 120 that limit the extent to which valve element 120 moves into the open position. According to various alternative and exemplary embodiments, the valve element may have any one of a variety of different configurations that is suitable for a particular application.

Valve body 122 is a rigid structure that serves to couple outlet check valve assembly 45 to head 32. According to one exemplary embodiment, valve body 122 includes an engagement structure 130, a first bore 132 configured to receive valve spring 124, a second bore 134 configured to receive plug 126, and an intermediate region 136 between the first bore 132 and second bore 134. Engagement structure 130 is configured to engage a corresponding engagement structure 131 in second bore 53 of head 32 to couple valve body 122 to head 32. One example of engagement structures 130 and 131 are cooperating threads that allow valve body 122 to be threaded or screwed into bore 53, although any suitable engagement structures that serve to couple valve body 122 to head 32 could be utilized.

First bore 132 is a blind bore that extends into valve body 122 from an end 137 of valve body 122 and that terminates at intermediate region 136. First bore 132 shares an axis with valve body 122 and is configured to receive valve spring 124. First bore 132 may also be configured to receive at least a portion of valve element 120.

According to one exemplary embodiment, second bore 134 (e.g., hole, orifice, recess, etc.) is a blind bore that extends into valve body 122 from an end 138 of valve body 122 (e.g., second bore 134 extends into valve body 122 from the opposite direction as first bore 132). Second bore 134 is coaxial with first bore 132 and includes an engagement structure 140, such as, for example threads, and a bottom 142 formed by intermediate region 136. Engagement structure 140 is configured to engage a corresponding structure on a plug 126 to enable plug 126 to be retained within second bore 134 in a manner that allows plug 126 to apply a force to bottom 142. According to various alternative and exemplary embodiments, the engagement structure of the second bore may be any suitable structure that is capable of cooperating with plug 126 to allow plug 126 to be forced against bottom 142 of the second bore. Bottom 142 is intended to be located near a portion of first bore 132 that is exposed to high tensile stresses, such as a corner 144 of first bore 132, such that when plug 126 is forced against bottom 142, corner 144 experiences a compressive preload. According to various alternative and exemplary embodiments, the axis of the second bore may be angled relative to the axis of first bore 132 (e.g., oriented other than parallel to the axis of first bore 132). For example, the second bore may extend radially inwardly or radially outwardly as it extends into valve body 122 from end 138. According to other various alternative and exemplary embodiments, the axis of the second bore may be parallel to, but spaced apart from, the axis of first bore 132. According to other exemplary and alternative embodiments, the second bore may be angled in another way relative to first bore 132. According to still other alternative and exemplary embodiments, the second bore may start and/or terminate at any locations on valve body 122 that are appropriate to allow plug 126 to apply an appropriate preload to a desired area.

Intermediate region 136 is the portion of material that is located between the end of first bore 132 and bottom 142 of second bore 134. As such, intermediate region 136 provides a contact surface for valve spring 124, is exposed to pressurized fuel that may pass between valve element 120 and first bore 51, and provides bottom 142 with which plug 126 comes into contact. According to various exemplary and alternative embodiments, the thickness of intermediate region 136 (i.e., the distance between bottom 142 and the end of first bore 132) may be varied based at least upon the pressures to which intermediate region 136 is exposed and packaging constraints.

Valve spring 124 is located within first bore 132 and is placed between valve element 120 and intermediate region 136. Valve spring 124 provides the force that biases valve element 120 into the closed position and is designed to provide valve element 120 with the appropriate valve opening pressure. According to various exemplary and alternative embodiments, the valve spring may be selected to provide different valve opening pressures.

Plug 126, which may be one of various types of set screws, pins, fittings, bolts, fasteners, screws, studs, etc., is an element that is received within second bore 134 and that is configured to be forced against bottom 142 of second bore 134 to apply a force to intermediate region 136. According to one exemplary embodiment, plug 126 is a generally cylindrical member having an engagement structure 150, an end 152, and an opposite end 154. Engagement structure 150 is configured to engage engagement structure 140 of second bore 134 in such a way that plug 126 may be forced against bottom 142 of second bore 134. One example of engagement structures 150 and 140 are cooperating threads that allow plug 126 to be threaded or screwed into second bore 134. With such cooperating threads, the amount of force applied to bottom 142 by plug 126 can be adjusted by rotating plug 126. End 152 is the portion of plug 126 that contacts bottom 142, while end 154 includes a recess 156 (e.g., engagement structure) that is configured to receive a tool that can be used to apply a torque to plug 126. According to one exemplary embodiment, recess 156 is a hexagonal socket that is configured to receive a hex tool or allen wrench. According to other alternative and exemplary embodiments, plug 126 may include, either as an alternative to or in addition to recess 156, a different structure that facilitates the application of a torque to plug 126. Such structure may include a hex-shaped head, a square head, a socket to receive a star bit, one or more slots to receive a regular or Phillips head screw driver, or any one or more of a variety of different structures that allow for the application of a torque to plug 126.

According to one exemplary embodiment, second bore 134 and plug 126 cooperate together to form a second preload system that is configured to apply a compressive preload to intermediate region 136, particularly the material forming corners 144. According to various alternative and exemplary embodiments, each outlet check valve assembly may include more than one plug/bore pair and the plug/bore pairs may be provided in any pattern and at any angle relative to first bore 132.

Although the preload systems and methods described herein were described in connection with only one pump configuration and in connection with two particular applications within that pump configuration, it should be understood that preload systems and methods of the type described herein could be used with many different pump types and configurations and could be used to apply a preload to any portions of the pump in which the application of a preload could be beneficial. In addition, it should also be understood that preload systems and methods of the type described herein could be used in connection with one or more of a variety of different devices and apparatuses other than pumps, including various fuel system components (e.g., fuel rails, accumulators, fuel injectors, accumulators, etc), hydraulic components, components having a finite size high-pressure area that may require structural preload, or any other components in which the application of a preload could be beneficial.

INDUSTRIAL APPLICABILITY

Pump 18 operates to pressurize a fluid (e.g., fuel) by drawing the fluid into one or more pumping chambers 86, reducing the size of pumping chambers 86, and then forcing the fluid through outlet check valve assemblies 45 to common rail 20. The way in which pump 18 operates will now be more specifically described in connection with one of pumping chambers 86. Starting from the beginning of the pumping cycle, plunger 80 is at bottom dead center and pumping chamber 86, which is normally full of fuel at this point, is at its maximum volume. As the peak of one of cam lobes 56 rotates to a position under tappet assembly 36, the cam lobe 56 forces tappet assembly 36, and therefore plunger assembly 43, upward. As plunger assembly 43 moves upward (according to the shape or contour of cam lobe 56), plunger 80 moves upward within region 76 of aperture 54 (and possibly region 74) in head 32 thereby reducing the volume of pumping chamber 86. Generally, at about the same time plunger 80 begins to move upward, solenoid 67 is energized, which has the effect of moving valve element 63 into the closed position where the pumping chamber 86 is closed off from fuel inlet passage 84. The pressure within pumping chamber 86 also helps to urge valve element 63 into the closed position. As a result of the pressure within pumping chamber 86, solenoid 67 may be deenergized during the pumping cycle without valve element 63 moving into the open position. As plunger 80 continues to move upward, the volume of pumping chamber 86 continues to reduce and the pressure of the fluid within pumping chamber 86 continues to increase. When the fuel pressure reaches a certain point, the fuel pressure acting on valve element 120 of outlet check valve assembly 45 will cause valve element 120 to move into the open position, which will then allow the pressurized fuel to be transported to common rail 20. The pumping cycle continues until plunger 80 reaches top dead center, which occurs when the peak of cam lobe 56 is below tappet assembly 36. Generally, after plunger 80 reaches top dead center and begins the filling cycle, solenoid 67 is deenergized (if it wasn't already deenergized during the pumping cycle) and the pressure drops enough to allow valve element 63 to move, pursuant to the bias provided by spring 66, to the open position where fuel from fuel inlet passage 84 is again permitted to enter pumping chamber 86. As the peak of cam lobe 56 rotates past tappet assembly 36, the bias provided by resilient element 40 urges plunger assembly 43 and tappet assembly 36 back down toward camshaft 34. At this point, the backside of cam lobe 56 is below tappet assembly 36, which allows tappet assembly 36 to move back down. As plunger 80 moves downward within aperture 54 during the filling cycle, fuel continues to fill pumping chamber 86. When plunger 80 reaches bottom dead center, pumping chamber 86 will normally be full of fuel and at its maximum volume. The cycle then starts over again, with the cam lobe 56 urging tappet assembly 36 and plunger assembly 43 back up toward top dead center.

Control valve assembly 42 may be activated and deactivated at different times during the pumping and filling cycles to control how much fuel enters pumping chamber 86 during the filling cycle and/or to control whether pumping chamber 86 is coupled to fuel inlet passage 84 (which is part of a fluid circuit that flows back to transfer pump 16 and therefore acts as a drain) during all or a portion of the pumping cycle. In this way, the output of the pump may be controlled.

Depending on the portion of time during the pumping cycle that valve element 63 is in the open position, pump 18 may pressurize fuel to significant pressures. For example, pressurizing fuel to between 150 and 190 MPa is not uncommon in many of today's common rail fuel pumps. At these high pressures, the fuel can apply substantial forces to the surfaces exposed to the fuel. The application of these substantial forces can subject portions of pump 18 to substantial tensile stresses, which, if not appropriate addressed, could result in pump failure. One area of pump 18 that may be subjected to high tensile stresses is pumping chamber 86, and in particular, corners 110 of pumping chamber 86. Pumping chamber 86 is directly exposed to high pressure fuel because that is where the volume of fuel is reduced to generate the pressure. Another area of pump 18 that may be subjected to high tensile stresses is intermediate region 136 of outlet check valve assembly 45, and in particular, corners 144 of first bore 132. First bore 132 may be exposed to high pressure fuel when valve element 120 is moved into the open position and pressurized fuel from pressure chamber 86 flows past valve element 120. Some of that fuel may flow between valve element 120 and first bore 51 and enter first bore 132. In addition, first bore 132 is located on the same side of seating surface 128 of valve element 120 as common rail 20. Thus, when valve element 120 is in the closed position, first bore 132 is still subjected to pressurized fuel from common rail 20 that may make its way between valve element 120 and first bore 51.

The first preload system is intended to help reduce the magnitude of the tensile stresses to which pressure chamber 86, and in particular, corners 110, are subjected by applying a compressive preload to corners 110. The reduction in the magnitude of the tensile stresses is then intended to improve the fatigue life of pressure chamber 86 and/or its pressure handling capability. To apply the compressive preload, each of plugs 47 is threaded into its corresponding bore 55 until end 114 of each plug 47 contacts bottom 108 of the corresponding bore 55. When ends 114 of plugs 47 contact bottoms 108 of the corresponding bores 55, each of plugs 47 applies a force to the corresponding bottom 108. The magnitude of the force applied by each plug 47 to the corresponding bottom 108 will depend on the magnitude of the torque applied to plug 47. The greater the torque, the more force plug 47 will apply to bottom 108. By adjusting the torque applied to plugs 47, the magnitude of the compressive preload applied by plugs 47 can be adjusted to whatever level is desired (within the structural limitations of the preload system). When positioned in the appropriate locations and oriented in the appropriate directions, the forces plugs 47 apply to bottoms 108 can result in the application of an overall compressive preload to corners 110 that can help to reduce the total magnitude of the tensile stresses to which corners 110 will be subjected when corners 110 are exposed to high pressure fuel. According to various alternative and exemplary embodiments, at least the number of plug/bore pairs, the location of the plug/bore pairs, the orientation of the plug/bore pairs, the size of the plug/bore pairs, the torque applied to the plugs, etc. can be adjusted as appropriate for any particular application.

Similarly, the second preload system is intended to help reduce the magnitude of the tensile stresses to which first bore 132 of outlet check valve assembly 45, and in particular, corners 144, are subjected by applying a compressive preload to corners 144. The reduction in the magnitude of the tensile stresses is then intended to improve the fatigue life of first bore 132 and/or its pressure handling capability. To apply the compressive preload, plug 126 is threaded into second bore 134 until end 152 of plug 126 contacts bottom 142 of second bore 134. When end 152 of plug 126 contacts bottom 142 of second bore 134, plug 126 applies a force to bottom 142. The magnitude of the force applied by plug 126 to bottom 142 will depend on the magnitude of the torque applied to plug 126. The greater the torque, the more force plug 126 will apply to bottom 142. By adjusting the torque applied to plug 126, the magnitude of the compressive preload applied by plug 126 can be adjusted to whatever level is desired (within the structural limitations of the preload system). When positioned in the appropriate location and oriented in the appropriate direction, the force plug 126 applies to bottom 142 can result in the application of a compressive preload to corners 144 that can help to reduce the total magnitude of the tensile stresses to which corners 144 will be subjected when corners 144 are exposed to high pressure fuel. According to various alternative and exemplary embodiments, at least the number of plug/bore pairs, the location of the plug/bore pairs, the orientation of the plug/bore pairs, the size of the plug/bore pairs, the torque applied to the plugs, etc. can be adjusted as appropriate for any particular application.

Because the appropriate use of the preload systems and methods described herein may help to reduce the magnitude of the tensile stresses to which a component is exposed, the preload systems and methods may be utilized to adapt an existing component design for use with higher fluid pressures or to design a new component in a more efficient and cost effective manner. For example, the incorporation of the preload systems and methods described herein into a particular component could provide the designer with the ability to utilize less material than would have otherwise been the case. The use of less material, often leads to reduced cost. The use of the preload systems and methods described herein may also help designers to reduce cost by giving them a tool with which they could adapt a particular component configuration or platform across different applications. For example, a designer could adapt a lower pressure platform or product configuration for use with higher pressures, as opposed to developing a separate higher pressure configuration that was suitable for higher pressure applications, by incorporating the preload systems and methods described herein.

It is important to note that the construction and arrangement of the elements of the preload systems and methods, as shown and described in the exemplary and other alternative embodiments is illustrative only. Although only a few embodiments of the preload systems and methods have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, orientations, etc.) without materially departing from the novel teachings and advantages of the subject matter recited. For example, elements shown as integrally formed may be constructed of multiple parts or elements shown as multiple parts may be integrally formed, the operation of the interfaces (e.g., the interfaces between plugs and the corresponding bores, etc.) may be reversed or otherwise varied, and/or the length, width, or diameters of the structures and/or members or connectors or other elements of the assemblies or systems may be varied. It should be noted that the elements and/or assemblies of the preload systems, including the plugs, may be constructed from any of a wide variety of materials that provide sufficient strength, durability, and other relevant characteristics, from any of a wide variety of different manufacturing processes, and in any of a wide variety of colors, textures, combinations, and configurations. It also should be noted that the preload systems and methods may be used in association with various types of pumps (including a variety of different piston pumps), with a variety of different mechanisms, devices, or apparatuses in a variety of different applications (high pressure applications, low pressure applications, etc.), and with a variety of different fluids (e.g., fuel, oil, hydraulic fluid, transmission fluid, water, coolant, etc.) Accordingly, all such modifications are intended to be included within the scope of the present disclosure. Other substitutions, modifications, changes and omissions may be made in the design, operating conditions and arrangement of the exemplary and other alternative embodiments without departing from the spirit of the present disclosure.

What is claimed is:

1. A preload system comprising:

a body including a body first portion and a body second portion;

a first bore formed in the body first portion and configured to be exposed to high tensile stresses;

a second bore formed in the body second portion and including a first engagement structure and a bottom positioned near the body first portion proximate a portion of the first bore that is exposed to the high tensile stresses, wherein the body further includes a surface entirely covering the bottom of the second bore; and a plug including a second engagement structure and a first end, the second engagement structure engaging the first engagement structure to force the first end of the plug against the surface of the body;

wherein the force of the plug against the surface of the body applies a compressive preload to the portion of the first bore that is exposed to the high tensile stresses.

2. The preload system of claim 1, wherein the first engagement structure and the second engagement structure are cooperating threads.

3. The preload system of claim 1, wherein the first bore and the second bore share a common axis.

4. The preload system of claim 1, wherein an axis of the second bore is spaced apart from an axis of the first bore.

5. The preload system of claim 1, wherein the second bore is two or more second bores.

6. The preload system of claim 5, wherein each of the two or more second bores includes an axis and wherein the axes of the two or more second bores are arranged around an axis of the first bore.

7. The preload system of claim 6, wherein the axes of the two or more second bores are each parallel to the axis of the first bore.

8. The preload system of claim 2, wherein the plug includes a second end and wherein the second end includes a third engagement structure configured to receive a tool for rotating the plug.

9. The preload system of claim 8, wherein the third engagement structure is a hexagonal socket configured to receive a hex head wrench.

10. The preload system of claim 1, wherein the body is a head of a high-pressure pump.

11. The preload system of claim 1, wherein the body is a valve body of an outlet check valve assembly for a high-pressure pump.

12. A pump comprising:

a housing;

a driven member coupled to the housing;

a head coupled to the housing and including a head first portion defining a first bore and a head second portion defining a second bore, the first bore including a first portion exposed to a pressurized fluid, the second bore including a bottom located near the first portion, wherein the head further includes a surface entirely covering the bottom of the second bore;

a plug coupled within the second bore, the plug configured to apply a force to the surface of the head; and a plunger coupled to the driven member and configured to reciprocate within the first bore in response to the driven member, the plunger having an axis different from an axis of the second bore, the plunger and the first bore at least partially defining a pumping chamber, the reciprocation of the plunger in the first bore resulting in the pressurization of the pressurized fluid within the pumping chamber;

wherein the pressurized fluid subjects at least the first portion of the first bore to tensile stresses; and wherein the force applied to the surface of the head by the plug subjects the head first portion to compressive stresses that at least partially offset the tensile stresses to which the head first portion is subjected by the pressurized fluid.

13. The pump of claim 12, wherein the first bore includes a valve bore configured to receive a portion of a control valve, a plunger bore for receiving the plunger, and an intermediate chamber located between the valve bore and the plunger bore.

14. The pump of claim 13, wherein the first portion of the first bore is between the intermediate bore and the valve bore.

15. The pump of claim 12, wherein the first portion of the first bore defines at least a portion of the pressure chamber.

16. The pump of claim 12, wherein the second bore includes a first engagement structure and the plug includes a second engagement structure, the second engagement structure configured to engage the first engagement structure to force the first end of the plug toward the bottom of the second bore.

17. The pump of claim 12, wherein an axis of the second bore is spaced apart from and parallel to an axis of the first bore.

18. The pump of claim 12, wherein the second bore is two or more second bores.

19. The pump of claim 18, wherein each of the two or more second bores includes an axis and wherein the axes of the two or more second bores are arranged around an axis of the first bore.

20. The apparatus of claim 19, wherein the axes of the two or more second bores are each parallel to the axis of the first bore.

21. A method of applying a compressive preload to a body including a body first portion defining a first bore having at least a portion which is exposed to high tensile stresses, the method comprising:

forming a second bore in a body second portion, the second bore having a bottom positioned near the body first portion proximate a portion of the first bore that is exposed to the high tensile stresses, wherein the body includes a surface entirely covering the bottom of the second bore; and forcing an end of a plug against the surface of the body; and continuing to force the end of the plug against the surface of the body until a compressive preload of a desired magnitude is applied to the portion of the first bore that is exposed to the high tensile stresses.

22. The method of claim 21, wherein the plug includes a first engagement structure and the second bore includes a second engagement structure and wherein the first engagement structure and the second engagement structure cooperate to allow the plug to be forced against the surface of the body.

23. The method of claim 22, wherein the first engagement structure and the second engagement structure are threads configured to cooperate with one another.

24. The method of claim 23, wherein forcing the end of the plug against the surface of the body further comprises rotating the plug.

25. The method of claim 24, wherein continuing to force the end of the plug against the surface of the body further comprises rotating the plug until a compressive preload of a desired magnitude is applied to the body first portion.

26. The method of claim 21, further comprising selecting the desired magnitude of the compressive preload based at least in part on the magnitude of the tensile stresses to which the portion of the first bore is exposed.

* * * * *